United States Patent [19]

Wilson

[11] 4,043,659

[45] Aug. 23, 1977

[54] CLEANING BLADE TONER ARRESTOR

[75] Inventor: Lionel A. Wilson, AL, England

[73] Assignee: Xerox Corporation, Stamford, Conn.

[21] Appl. No.: 565,319

[22] Filed: Apr. 4, 1975

[30] Foreign Application Priority Data

May 24, 1974 United Kingdom ..... 23707/74

[51] Int. Cl.[2] ..... G03G 21/00

[52] U.S. Cl. ..... 355/15; 15/256.51; 118/652

[58] Field of Search ..... 355/15, 10; 15/1.5, 15/256.5, 256.51, 256.52, 236 R, 236 A, 245; 118/104, 203, 204, 652

[56] References Cited

U.S. PATENT DOCUMENTS

| | | | |
|---|---|---|---|
| 2,081,735 | 5/1937 | Caronia | 15/235 R UX |
| 2,525,920 | 10/1950 | Mackey | 118/204 |
| 2,777,676 | 1/1957 | Carter | 15/236 R UX |
| 2,964,773 | 12/1960 | Pence | 15/245 |
| 3,759,220 | 9/1973 | Saito et al. | 118/104 X |
| 3,776,632 | 12/1973 | Smith et al. | 355/15 |
| 3,850,099 | 11/1974 | Laben | 15/256.51 X |

*Primary Examiner*—Fred L. Braun

[57] ABSTRACT

A cleaning apparatus for cleaning material from a support surface and an electrostatographic reproduction apparatus employing it. The apparatus includes a cleaning blade having an edge positioned to contact the support surface. A recess is provided in the cleaning edge at at least one end thereof to prevent liquid developer from flowing around the end of the blade.

3 Claims, 2 Drawing Figures

CLEANING BLADE TONER ARRESTOR

Figure 1:
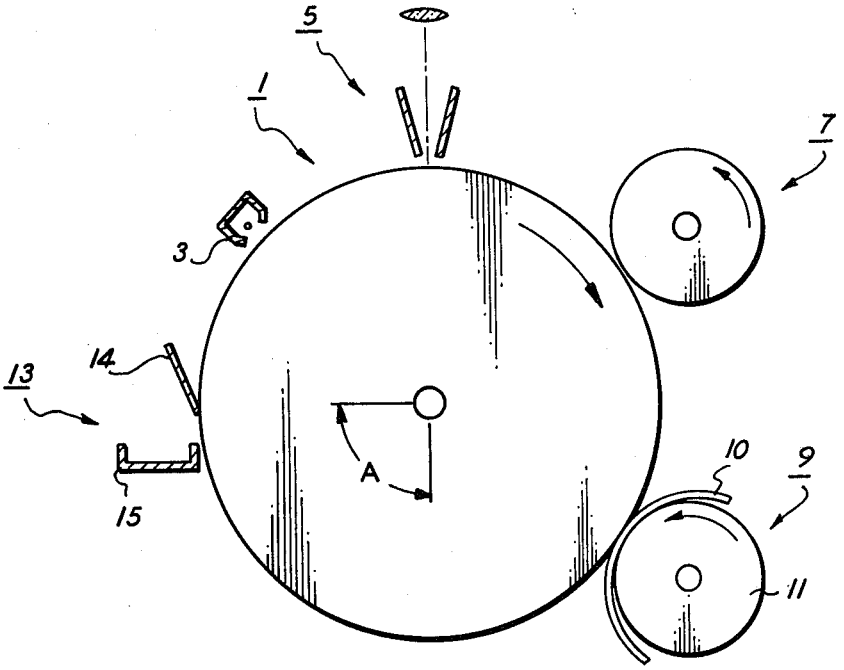

This invention relates to imaging systems, and more particularly to cleaning in liquid development systems for developing electrostatic charge pattern images present on electrophotographic layers.

The formation and development of images on the surface of photoconductor material by electrostatic means is well known. The basic xerographic process as taught by C. F. Carlson in U.S. Pat. No. 2,297,691 involves placing a uniform electrostatic charge on a photoconductive insulating layer, exposing the layer to a light and shadow image to dissipate the charge on the areas of the layer exposed to the light and developing the resulting electrostatic charge pattern image by depositing on the image a finely divided electroscopic marking material referred to in the art as "toner". The toner will normally be attracted to those areas of the layer which retain a charge thereby forming a toner image corresponding to the electrostatic charge pattern. The powder image may then be transferred to a support surface such as paper and permanently affixed to the support by any suitable means such as heat fixing or solvent fixing. Alternatively, the powder image may be fixed to the photoconductive layer if elimination of the powder transfer step is desired. In addition, instead of forming a charge pattern by uniformly charging a photoconductor followed by image-wise light exposure, a charge pattern may be formed by directly charging the layer in image configuration. Other methods are known for applying electroscopic particles to the imaging surface. Included within this group are the "cascade" development technique disclosed by E. N. Wise in U.S. Pat. No. 2,618,552; the powder cloud development technique disclosed by C. F. Carlson in U.S. Pat. No. 2,221,776; and the magnetic brush process disclosed, for example, in U.S. Pat. No. 2,874,063.

Development of a charge pattern image may also be achieved with liquid rather than dry developer materials. In conventional liquid development more commonly referred to as electrophoretic development an insulating liquid vehicle having finely divided solid material dispersed therein contacts the imaging surface in both charged and uncharged areas. Under the influence of the electric field associated with a charged image pattern, the suspended particles migrate towards the charged portions of the imaging surface separating out of the insulating liquid. This electrophoretic migration of charged particles results in the deposition of the charged particles on the imaging surface in image configuration. Electrophoretic development of a charge pattern may, for example, be obtained by pouring the developer over the image surface, by immersing the image surface in a pool of the developer, or by presenting the liquid developer on a roller and moving the roller against the imaging surface. The liquid development technique has been shown to provide developed images of excellent quality and to provide particular advantages over other development methods in offering ease in handling.

Automatic copying machines employing liquid development techniques generally can be divided into two categories. In the first, an electrophotographic sheet is developed and the sheet and developed image is used as final copy. In the second an image is developed on a photoconductive surface and the image is subsequently transferred to a transfer sheet which forms the final copy with the photoconductive element being reused for subsequent copies. Where the photoconductive surface is to be reused it is essential that the liquid developer material which contacts the photoconductive drum be removed or at least reduced to a level which will not interfere with subsequent process steps such as charging and exposure. Many techniques have been provided for removing excess liquid developer and toner material present on the surface of the photoconductive drum after the image has been transferred to a transfer sheet. These techniques include web cleaning, washing the photoconductive drum with clear liquid or by cleaning blade. Since the use of web cleaning and liquid washing are relatively complex cleaning blades are preferred for their simplicity. There is a continuing need for improved cleaning blade designs for removal of contaminents from support surfaces.

Typical of the prior art with respect to blade cleaning following liquid development are U.S. Pat. Nos. 3,711,796 and 3,759,220. The devices of these patents include a photosensitive medium having liquid collection grooves and a cleaning blade having projections at opposite ends thereof which extend into the grooves.

It is, therefore, an object of this invention to provide an improved member for removing contaminents from the surface of a support member.

According to the invention there is provided a cleaning apparatus for cleaning material from a support surface adapted to move in a given direction, which includes a cleaning blade having an edge positioned to contact said surface; said cleaning blade having a recess in at least one end of said edge, the opening of said recess arranged to face against the direction of the support surface movement.

Figure 2:
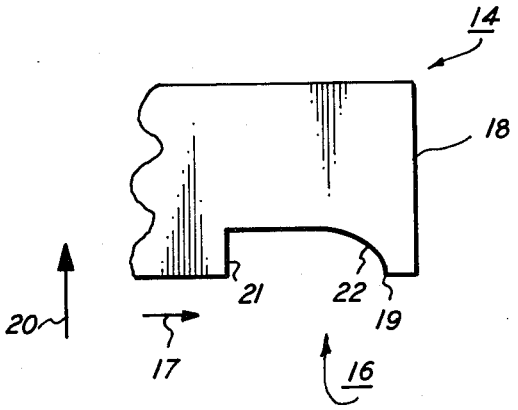

An embodiment of the invention will now be described by way of example with reference to the accompanying drawing in which:

FIG. 1 is a schematic representation of a simplified xerographic system showing the various major process steps and the relationship of a cleaning blade of this invention to the other major process stations; and FIG. 2 shows a typical example of a cleaning blade having a recess in accordance with this invention.

Referring now to FIG.. 1 there is shown a xerographic member generally designated 1 which in this instance is a photoconductive selenium coated on a conductive drum. In operation drum 1 is charged in the dark to a uniform electrostatic potential by charging device 3 which is here shown as a source of corona. Alternatively, the photoconductor could be charged, for example, by frictional contact. Charged member 1 is then exposed to a light image at the exposure station generally designated 5. The charged surface being photoconductive when exposed to light to which it is responsive will become conductive in light struck areas allowing the surface charge to move through to the conductive drum leaving a pattern of charge on the surface of the drum corresponding to the non-light struck areas. The electrostatic image thus formed is then made visible at developing station generally designated 7 where liquid developer is applied to the photoconductive surface. Developing station 7 may be, for example, a roller supplied with a controlled amount of liquid developer. The developer is, conventionally, particles of an insulating colorant material dispersed in an insulating clear carrier liquid. Insulating materials are preferred to prevent discharge of the electrostatic image. When the liquid developer is brought into contact with the photoconductive surface particles of colorant called toner is attracted to the charged areas of the photoconductive surface forming a visible image thereon. Alternatively, by proper selection of the toner and liquid carrier materials and the operating conditions the toner can be made to deposit on background or non-charged areas in a process called "reversal imaging". Whatever development technique is used the image now visible is transferred to a receiver member at transfer station generally designated 9. At transfer station 9 receiver member 10 which may be, for example, paper entrained over roller 11 is pressed into contact with the toner image on member 1. The toner is thus transferred to the receiver member forming the final copy. The transfer of toner to the receiver member may be assisted by applying an electrical field of the proper polarity between roller 11 and drum 1. Even with electric field assisted transfer some toner and liquid remains on the surface of member 1 which must be removed before the photoconductive surface can be reused. Contamination of the surface of member 1 interferes with subsequent charging and imagewise discharging steps. This can readily be understood when it is considered that the developer material is insulating which means that the imagewise exposure will not discharge the materials and the colorant material further acts as a mask preventing the light discharge of the photoconductive surface. Further, the contamination which is recycled may transfer at transfer station 9 interfering with the quality of the final copies produced. It can be seen that it is necessary to clean the photoconductive surface before it is reused. This is accomplished at cleaning station generally designated 13. The cleaning station, in accordance with this invention, comprises cleaning blade 14 and collector tray 15. The cleaning blade "piles up" the liquid developer until there is sufficient weight of liquid to cause it to fall into collector tray 15. It has been found that due to surface tension and capillary forces that liquid has a tendency to flow towards and build up at the ends of the cleaning blade. Eventually, the developer moves around the end of the cleaning blade forming two lines of developer contamination on the photoconductive surface corresponding to the ends of the cleaning blade. Using a longer cleaning blade results in developer reaching the end of the member 1 itself which is very undesirable. The present invention is directed to preventing the movement of liquid developer around the ends of the cleaning blade. It should be pointed out here that for simplicity of machine design it is preferred to locate the cleaning blade at a position relative to the drum so that the liquid accumulated by cleaning blade 14 falls by gravity into collector 15. For this reason it is preferred to locate the cleaning blade in the quadrant between the bottom of the drum and, moving in the direction of the photoconductor surface, horizontal. This quadrant is represented by the letter A in FIG. 1.

Referring now to FIG. 2 there is shown cleaning blade generally designated 14 which may be, for example, a flat blade made of a resilient material such as rubber or plastic. A recess generally designated 16 is formed in both ends of the cleaning blade, only one end being shown in FIG. 2. Liquid developer moving in the direction represented by arrow 17 towards end 18 of cleaning blade 14 flows into the recess 16. The surface being cleaned is moving in the direction indicated by arrow 20. It has been found that the liquid becomes trapped in the recess and builds into a larger mass which falls into the collector tray being unable to move around point 19. Pocket or recess 16 therefore forces the liquid into a mass large enough to overcome surface tension forces before it is allowed to continue its path toward blade end 18. Although other shapes of recess may be used it has been found that a recess such as shown with a right angle wall 21 towards the center of the blade and an arcuate wall 22 towards the blade end is preferred. Where wall 21 meets the back wall of the recess a small radius may be formed to prevent cracking of the blade at that point. The dimensions of the cleaning blade and recess can vary greatly depending on the service in which used. However, for removing liquid developer from a photoconductive surface of conventional sizes a recess measuring about 5mm long by about 0.5 mm wide has been found to be satisfactory in a polyurethane blade measuring 2 mm thick. It can be seen that the cleaning blade must be relatively flexible to ensure that the back or edge formed by the recess is in contact with the photoconductive surface otherwise a gap would be formed which would allow developer liquid to pass through it. This consideration also limits the size of the recess. Also the recess must be very close to the end of the blade to trap as much material as possible.

While particular embodiments of the invention have been described above, it will be appreciated that various modifications may be made by one skilled in the art without departing from the scope of the invention as defined by the appended claims.

What is claimed is:

1. An electrostatographic reproducing apparatus comprising: a movable support surface; means for forming a charge pattern on said surface; means for developing the charge pattern with liquid developer to form a developed image; means for transferring the developed image to a receiver member; said support surface being adapted to move in a given direction past each of said means in succession; and cleaning apparatus comprising a flexible cleaning blade having an edge positioned in contact with said surface, said cleaning blade having a recess solely in each of the ends of said edge, each of said recesses defining an opening which is arranged to face against the direction of support surface movement, and wherein edges formed by said recesses are positioned in contact with said surface.

2. An electrostatographic reproducing apparatus comprising: a movable support surface; means for forming a charge pattern on said surface; means for developing the charge pattern with liquid developer to form a developed image; means for transferring the developed image to a receiver member; said support surface being adapted to move in a given direction past each of said means in succession; and cleaning apparatus comprising a cleaning blade having an edge positioned in contact with said surface, said cleaning blade having a recess in at least one end of said edge, said recess defining an opening which is arranged to face against the direction of the support surface movement, said recess having a first wall, said first wall being at least approximately at right angles to said cleaning blade edge and being nearest the center of the cleaning blade and having a second wall, said second wall being nearest the outer end of the cleaning blade, said second wall being arcuate.

3. The apparatus of claim 2, wherein said cleaning blade comprises a flexible cleaning blade and wherein said recess is provided in each of the ends of said edge and wherein edges formed by said recesses are positioned in contact with said surface.

* * * * *